United States Patent [19]

Nissen et al.

[11] 4,162,063

[45] Jul. 24, 1979

[54] ADJUSTABLE SPRINGS FOR TRAMPOLINES AND THE LIKE

[75] Inventors: George P. Nissen; Harlan J. Kelly, both of Cedar Rapids, Iowa

[73] Assignee: Nissen Corporation, Cedar Rapids, Iowa

[21] Appl. No.: 649,508

[22] Filed: Jan. 15, 1976

[51] Int. Cl.[2] ..... A63B 5/18; F16F 1/12

[52] U.S. Cl. ..... 267/73; 5/233; 5/260; 182/139; 267/89; 272/65

[58] Field of Search ..... 267/69, 73, 74, 99, 267/112, 89, 166–168, 170, 174, 175, 177–179; 5/233, 253, 256, 260; 182/138, 139, 140; 272/65, 66

[56] References Cited

U.S. PATENT DOCUMENTS

| | | | |
|---|---|---|---|
| 1,588,471 | 6/1926 | Bezkorowajnyj | 267/74 |
| 1,641,268 | 9/1927 | Halliburton | 267/69 |
| 1,759,719 | 5/1930 | Spino et al. | 267/74 |
| 2,248,447 | 7/1941 | Wood | 267/73 X |
| 3,610,607 | 10/1971 | Pofferi | 267/89 |
| 3,767,009 | 10/1973 | Sidlinger | 182/139 |

*Primary Examiner*—Johnny D. Cherry

*Attorney, Agent, or Firm*—Haven E. Simmons; James C. Nemmers

[57] ABSTRACT

The typical helical springs used to support the bed within the frame of a trampoline or the like are modified to incorporate adjustable hooks threadedly anchored within the springs at one end so that their overall length, and thus the tension on the bed, can be varied and overstretching accommodated. Two principal versions are disclosed, the more preferred one including an additional inner spring biasing the adjustable hook to a retracted position.

5 Claims, 3 Drawing Figures

ADJUSTABLE SPRINGS FOR TRAMPOLINES AND THE LIKE

BACKGROUND OF THE INVENTION

While sometimes lengths of elastic cable or "shock cord" are used to support trampoline beds (see U.S. Pat. No. 2,916,746, for instance), far more prevalent are extensible metal springs having integrally formed hooks at their ends. Typically, these are all of uniform, overall free length, at least initially, and are helically wound with their coils stacked on each other. Indeed, often the coils are also wound with a certain amount of "backload," as it were. This is done to provide an increased initial tension and thus shorten the distance the spring must be pulled out, as compared with a "non-backloaded" spring, to bring it up to the desired tension for the bed. Hence the bed can be larger relative to the frame with "backloaded" springs than it can with "non-backloaded" springs. Nevertheless, after a while all springs, even "backloaded" ones, tend to become overstretched, particularly after periods of hard use or by heavy performers, and thus lessen the tension on the bed. Several springs can become severely overstretched should they be accidentally stepped on by a performer. Sometimes even the springs are overstretched when being initially installed. Once overstretched the springs customarily have to be replaced. There are other problems, too.

If the frame or the bed is not exactly rectangular, or if either is of an odd side, obviously the tension on the bed will not be uniform, or will be all too much or all too little, since the springs are all initially of equal free length. Nor can the tension of the bed be adjusted to accommodate the weight or skill of performers. Some of the heavier performers or those who bounce extremely high may be in danger of striking the floor or even the trampoline undercarriage, while lighter or less skillful performers may prefer a less "hot" bed, as those with greater tension or resiliency are sometimes called. Furthermore, when a trampoline is folded up, as can be done with most by folding the third or so of the frame and bed at each end over onto the middle third (see U.S. Pat. No. 3,116,809, for example), the tension on the springs across each end of the bed is so reduced that they can and often do become detached from the bed or even fall off completely. The hooks at the ends of the springs, since they are integrally formed from the same relatively small diameter wire that makes up the bodies of the springs, tend to wear the spring anchors along the trampoline frame rather rapidly so that those anchors must be repaired or the frame replaced. In short, then, the simple, integral metal springs so long used for trampolines are in fact innately deficient in quite a number of respects which, depending upon the conditions, impede the adaptability and performance of the trampolines of which they are so vital a part.

For years, for some reason, these impediments in trampolines have nevertheless been unwittingly suffered and only recently have received any really serious attention. It was then recognized that the source of the foregoing deficiencies lies primarily in the springs themselves. This in turn resulted in a first step which ultimately lead to the present invention. That first step was to make the area of the bed somewhat smaller and then employ one or more "spring extenders" on each spring. These extenders are simply bent from heavy wire and include an "eye" at one end and a hook at the other, the distance between the two being about one inch. Hence, when the springs are initially installed, one or two such extenders are used at the end of each spring adjacent the frame to provide the proper initial spring tension. Then when the springs become overstretched, instead of discarding them, proper tension on the bed can be restored simply by removing one or both of the extenders. This is possible owing also to the recognition that, on account of Hooke's Law and within limits of course, an overstretched spring retains the same elastic characteristics as it had initially. That is to say, for example, that if the free length of a "non-backloaded" spring is initially nine inches and to provide proper tension it has to be pulled out to thirteen inches, then if it later becomes overstretched so that its free length is, say eleven inches, it will still provide the same tension if it is pulled out to fifteen inches. If the spring was also initially "backloaded," however, it might have to be pulled out only to twelve inches in order to provide the same tension as the "non-backloaded" spring when pulled out to thirteen inches. But once a "backloaded" spring becomes overstretched, since the "backload" is thereby destroyed, it too might have to be pulled out to fifteen inches in order to provide the same tension as the overstretched "non-backloaded" spring. Consequently, the distance "backloaded" springs must be pulled out to provide proper tension once they are overstretched is significantly greater than before because then, in effect, they have the same characteristics as "non-backloaded" springs.

While the spring extenders allow overstretched springs to be reused, and also permit adjustment of bed tension, they are not wholly satisfactory for a number of reasons. In the first place, they permit adjustment only in fixed intervals, i.e., the length of one extender. In the second place, the total number of them for a single trampoline, several hundreds in fact, means a great number of separate, relatively small parts which require extra time and care to install and which easily become lost or misplaced. When "backloaded" springs are used, even more extenders are initially necessary in order to allow sufficient distance for adjustment should they become overstretched since, as pointed out above, the springs then have the characteristics of "non-backloaded" springs. Spring extenders also exacerbate the problem of loose springs across the ends of the bed when a trampoline is folded up because many of the extenders invariably fall off on the floor and are lost in this fashion. Nevertheless, they did prove out the recognition that it is the springs themselves, especially their fixed free length, which are the source of the many deficiencies which plague the adaptability and performance of current trampolines.

SUMMARY OF THE INVENTION

Some months after various trial episodes with spring extenders the first or basic version of the present invention was conceived and tried out. This consisted of cutting off the hooks at the frame end of the springs and anchoring nylon or aluminum plugs within those ends. The plugs in turn threadedly receive relatively long shanks having hooks formed at their outer ends, the diameter of the material being much greater than that of the wire from which the springs themselves are wound. This immediately accomplished several desirable things. By adjustment of the hooks in or out of the springs the exact amount of any desired tension can be imposed upon the bed, and easily verified at any time, in order to accommodate the wishes, skill or weight of different performers. Beds can be made smaller in order to permit a wide range of spring adjustment and to accommodate elastic cables which are necessarily longer than springs of equivalent characteristics. Springs and cables can thus be used interchangeably, something not possible with current springs of fixed lengths. Odd size beds can be easily fitted within standard frames, and sprung or out of line frames to standard beds. The tension of overstretched springs can be restored simply by adjusting the hooks. The springs can also be more easily attached to the bed and the frame, reducing the danger of overstretching or other damage which sometimes occurs when initially fitting a bed to a frame. The large diameter of the adjustable hooks reduces wear on the spring anchors along the frame since the loads on the anchors are spread over larger areas. Finally, and of no small importance, is the fact that virtually the same machinery and processes can also be used to make the modified springs.

The second, more preferred version of the invention arose a few months after the first. That involves enlarging the axial bores through the nylon or aluminum plugs so that the shanks of the adjustable hooks are freely slidable instead of being threaded therein, then equipping the inner ends of the shanks with nuts between which and the inner ends of the plugs are loosely captured light compressible coil springs. Hence, adjustment of spring length is accomplished by turning the hooks relative to the nuts, rather than relative to the plugs. Besides having all the features of the first version of the invention, the second version produces a number of additional advantages.

The adjustable hooks can at all times be quickly slid, rather than requiring them to be laboriously turned, into the ends of the springs. This results in the springs all having a readily achieved and uniform minimum free length. Thus, especially for shipping economy and convenience, the springs can be pre-assembled and standard cartons used, indeed, the same cartons as those for non-adjustable springs since the free length of the former when collapsed is the same as the free length of the latter. The light inner springs can assist initial installation of the bed since when the springs proper are first hooked between the bed and the frame, the adjustable hooks are pulled out against the tension of the inner springs, whereby the springs proper are held in place until all have been installed. Hence, tensioning of the bed can thereafter be begun without the springs tending to fall off during the process. When the trampoline is folded up, and tension on the springs across the ends of the bed thereby greatly reduced, the inner springs nevertheless maintain sufficient tension to keep the springs proper in place. The chance of damage to the springs during installation and tensioning, either initially or from time to time afterwards, is also reduced. With current springs the tendency is to grab the body of a spring with one or both hands in order to pull it out and hook it up, often overstretching it. With the more preferred version of the invention, however, it becomes more convenient and "natural" instead to use no hand at all on the bodies of the springs but rather to use an extra spring or a spring puller to engage the adjustable hooks, first to pull them out against the inner springs, and then to stretch the springs proper and hook them in position. At the same time, that extra spring or puller serves as a convenient means to rotate the adjustable hooks in order to adjust the tension of the springs upon the bed. In short, the second or more preferred version of the invention has some significant advantages over the first or basic version, while both are a great improvement over current springs of fixed free length whether used with or without spring extenders.

DESCRIPTION OF THE PREFERRED EMBODIMENTS

Figure 1:
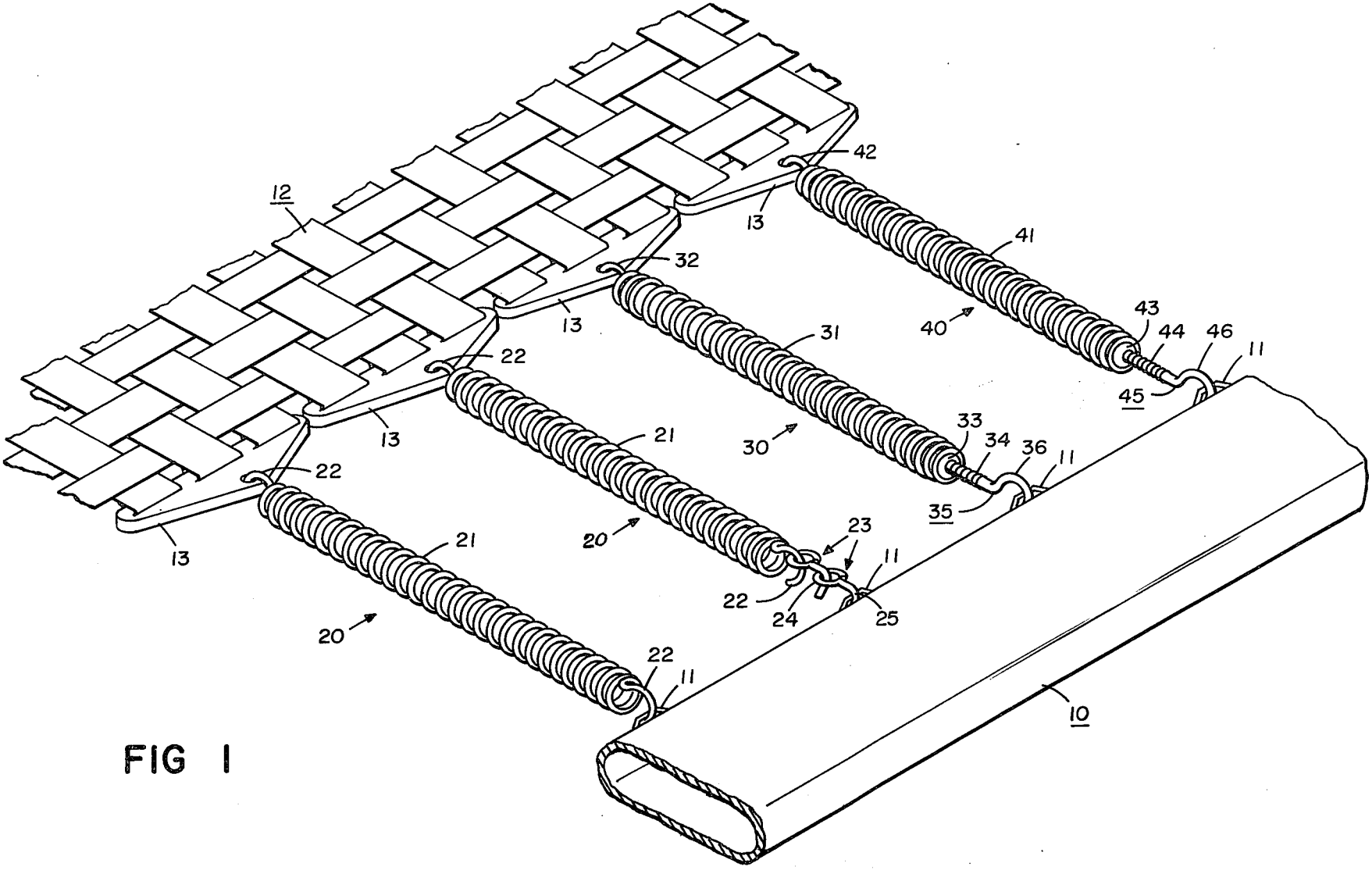
FIG. 1 is an isometric view of a portion of a typical trampoline frame and bed illustrating in place, first, a current type of fixed length spring, second, one of the latter employing two spring extenders, third, the first or basic version of the present invention, and finally, the second or more preferred version.

As noted, FIG. 1 illustrates a portion of a typical trampoline frame 10, formed of flattened metal tubing, having spaced spring anchor loops 11 welded along its inner edge. Opposite the latter, the trampoline bed 12, formed from interwoven and stitched strips of nylon material, is equipped with delta-shaped spring anchor bars 13. As also noted, FIG. 1 illustrates four examples of extensible helical springs connected between the anchor loops 11 and bars 13. The first of these is an integral spring 20 of fixed overall free length typical of those currently used for trampolines. Each spring 20 consists of a spring body 21, which may be wound to provide a desired amount of "back-load," e.g. 12–15 lbs., having somewhat tapered ends which terminate in integrally formed and aligned hooks 22. Next is an identical spring 20 together with two "spring extenders" 23. As previously mentioned, each of these consists of heavy wire bent at one end to form "eyes" 24 and at the other, hooks 25. By removing or adding extenders 23, the length and thus the tension of the springs 20 can be varied in fixed intervals, depending upon the length of each extender 23 which is a nominal one inch.

Figure 2:
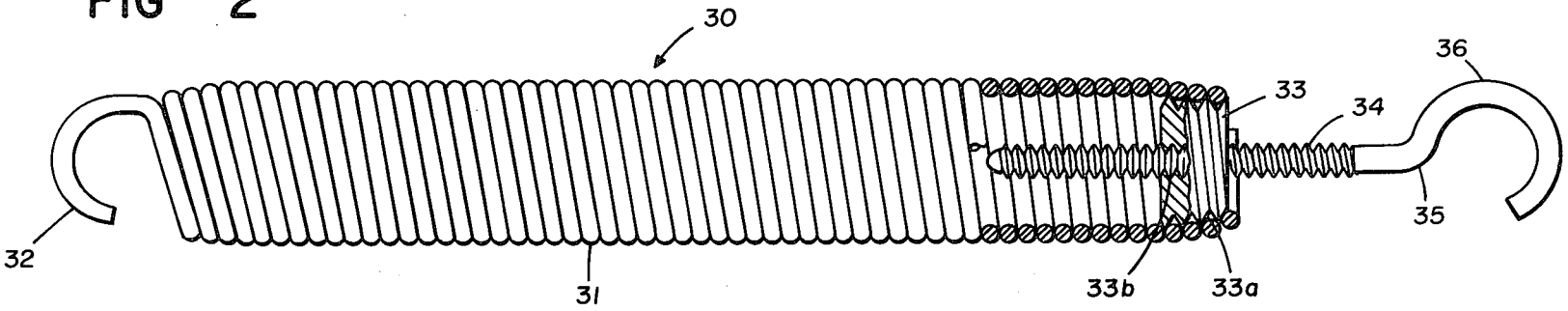
FIG. 2 is a partially sectioned side elevation of a spring incorporating the basic or first version of the invention.

An example of the first or basic version of the present invention is illustrated next in FIG. 1 and consists of a spring assembly 30 (formed from a spring 20 by cutting off its hook 22 at the frame end) having a spring body 31 with its remaining integral hook 32 engaging an anchor bar 13. Into the frame end of the spring body 31 is pressed a cylindrical nylon or aluminum plug 33 having peripheral serrations **33*a* to anchor it therewithin. The plug 33 is provided with an axially extending bore 33*b* therethrough equipped with an internal helical thread, all as more clearly shown in FIG. 2. Into the bore 33*b* is turned the externally helically threaded shank 34 of an adjusting hook 35 having an outer hooked portion 36. Thus by turning the hook 35 in or out of the plug 33 by which it is retained within the spring body 31, the overall length of the spring assembly 30** and thus its tension when installed can be adjusted.

Figure 3:
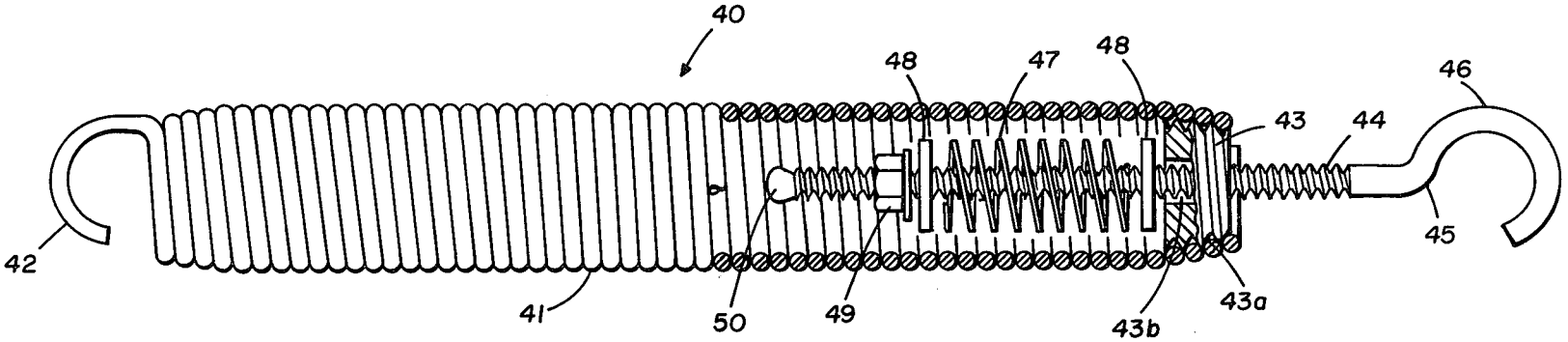
FIG. 3 is similar to FIG. 2 but illustrating the second or more preferred version of the invention.

The second or more preferred version of the invention is shown finally in FIG. 1 and likewise consists of a spring assembly 40 (also formed from a spring 20 by cutting off its hook 22 at the frame end) having a spring body 41 with its remaining integral hook 42 engaged with an anchor bar 13. Within the frame end of the spring body 41 is also pressed a cylindrical nylon or aluminum plug 43 having peripheral serrations 43*a* to anchor it therewithin. The plug 43 is also provided with an axial bore 43*b* therethrough but the latter is smooth and of greater diameter than the threaded plug bore 33*b* in the spring assembly 30, all as more clearly shown in FIG. 3. The bore 43*b* slidably receives the externally helically threaded shank 44 of an adjusting hook 45 having an outer hooked portion 46. Here it may be noted that the diameter of the material of both hooks 35 and 45 is substantially greater than that of the material of the spring bodies 31 and 41 and hooks 32 and 42. Furthermore, the shank 44 normally extends a greater distance into the spring body 41 than does the shank 34 into the spring body 31. Over the portion of the shank 44 inboard of the inner end of the plug 43 is slipped a light compressible coil spring 47 together with a pair of washers 48 of frictional material at its ends, and finally an internally helically threaded nut 49 is turned on the shank 44 to capture the spring 47 between the inner axial end of the plug 43 and the washers 48. Removal of the nut 49 is prevented by flattening, for example, the inner end of the shank 44 at 50. The plug 43, hook 45, spring 47, washers 48 and nut 49 are first assembled and then inserted as a unit into the frame end of the spring body 41.

With the first version of the invention, as mentioned above, the overall length of the spring assemblies 30 and thus the tension on the bed 12 is adjusted simply by turning the hooks 35 in or out of the plugs 33. The second version of the invention is similar in that the length and thereby the tension of the spring assemblies 40 are also adjusted by turning the hooks 45. However, in order to do this, the hooks 45 are first pulled outwardly from the plugs 43 in order to compress the inner springs 47 so that their ends and the opposed faces of the plugs 43 and the nuts 49 engage the washers 48 to hold the nuts 49 against rotation while the hooks 45 are turned. Preferably, when either version of the invention is initially installed on a trampoline, the hooks 32 or 42 are first engaged with the anchor bars 13, then an extra spring or a spring puller is used to engage the hooks 35 or 45 to pull out the spring bodies 31 or 41 and finally to engage the anchor loops 11. Once all the spring assemblies 30 or 40 are installed the tensioning procedure can be begun. This involves releasing the hooks 35 or 45 one by one and using the extra spring or puller to rotate the former until the spring assemblies 30 or 40 are shortened or lengthened sufficiently so that they provide proper tension on the bed 12 when re-engaged with the anchor loops 11. Adjustments to increase or decrease tension on the bed 12 can be made in the same manner from time to time in order to suit different performers or needs. Should any of the spring assemblies 30 or 40 later become overstretched, the same procedure can be used to shorten them and thus restore their tension.

The most efficient manner of tensioning and adjusting either of the spring assemblies 30 or 40 is a tool, incorporating a tension gauge, which unhooks each spring assembly 30 or 40 from its anchor loop 11, holds it by its hook 35 or 45 stretched to its proper length above the anchor loop 11, and then rotates the hook 35 or 45 until the gauge registers the desired tension. A simple tension gauge might be also incorporated in each spring assembly 30 or 40 itself by replacing its hook 32 or 42 with an assembly much like that at the frame end of the hook assemblies 40, except that there would need be no threads on the shank of the hook and the "nut" on the end of the latter would be fixed in place. In such a case, much stronger inner springs would be employed at the bed ends since they together with markings along the shanks of the hooks would constitute the tension gauge. Thus spring tension could be adjusted simply by rotating the spring bodies 31 or 41, without need to unhook the spring assemblies 30 or 40 at either end, though rotation of the spring bodies 31 or 41 would have to be prevented during use of the trampoline to avoid upsetting the tension adjustment.

In any event, though the present invention has been described in terms of specific embodiments, being the best modes known of carrying out the invention, it is not limited to those embodiments alone. Instead, the following claims are to be read as encompassing all adaptations and modifications of the invention falling within its spirit and scope. We claim:

1. In a trampoline having a flexible bed spacedly surrounded by a frame, and a plurality of extensible helical spring assemblies resiliently suspending the bed relative to the frame, each spring assembly having a spring body with opposite axial ends, one of the ends having a first hook thereat engaging one of the bed and the frame, the other end having a second hook thereat engaging the other of the bed and the frame, the improvement wherein the second hook includes a shank portion extending axially into said spring body end and a hook portion disposed at the outer end of the shank portion, the shank portion being cylindrical and having an external helical thread extending axially along the cylindrical periphery of the shank portion; an anchor member at said spring body end having a bore therethrough axially of the spring and slidably receiving the shank portion; and a retaining member disposed within the spring body inboard of the inner axial end of the anchor member, the retaining member having a bore therethrough axially of the spring body with an internal helical thread complementary with and threadedly engaging the external thread of the shank portion.

2. The trampoline of claim 1 including an inner compressible helical spring about the shank portion between the inner axial end of the anchor member and the retaining member, the inner spring being compressible between the anchor and retaining members upon axial sliding movement of the shank portion outwardly from said spring body end.

3. In an extensible, helical spring assembly for resiliently suspending the bed relative to the frame of a trampoline, the spring assembly having a spring body with opposite axial ends, one of the ends having a first hook thereat for engagement with one of the bed and the frame, the other end having a second hook thereat for engagement with the other of the bed and the frame, the improvement wherein the second hook includes a cylindrical shank portion extending axially into said spring body end and a hook portion disposed at the outer end of the shank portion; means for retaining the shank portion within said spring body end, the retaining means including an anchor member at said spring body end having a bore therethrough axially of the spring and receiving the shank portion, the shank portion being axially slidable in and relative to the bore through the anchor member, and a retaining member disposed within the spring body inboard of the inner axial end of the anchor member; and means for adjusting the axial extension of the shank portion from and relative to said spring body end and thereby the overall axial length of the spring assembly relative to a given tension imposed thereon, the adjusting means including an external helical thread extending axially along the cylindrical periphery of the shank portion, the retaining member having a bore therethrough axially of the spring body with an internal helical thread complementary with and threadedly engaging the external thread of the shank portion.

4. The spring assembly of claim 3 including an inner compressible helical spring about the shank portion between the inner axial end of the anchor member and the retaining member, the inner spring being compressible between the anchor and retaining members upon axial sliding movement of the shank portion outwardly from said spring body end.

5. The spring assembly of claim 4 wherein the anchor member comprises a plug pressed into said spring body end, and wherein the first hook is integral with the spring body.

* * * * *